US008208824B2

(12) United States Patent
Shelef et al.

(10) Patent No.: US 8,208,824 B2
(45) Date of Patent: Jun. 26, 2012

(54) CORRECTION METHOD, APPARATUS, DATA CARRIER OR SYSTEM FOR CORRECTING FOR UNINTENDED SPATIAL VARIATION IN LIGHTNESS ACROSS A PHYSICAL IMAGE PRODUCED BY A XEROGRAPHIC PROCESS

(75) Inventors: Eyal Shelef, Tel-Aviv (IL); Shlomo Harush, Nes-Ziona (IL); Gregory Braverman, Hertzelia (IL); Maya Shalev, Tel Aviv (IL); Barak Markus, gaalya (IL); Gidl Amir, Ness Ziona (IL); Craig Breen, Rehovot (IL); Haim Livne, Kfar-Sava (IL); Michael Plotkin, Rehovot (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 676 days.

(21) Appl. No.: 12/300,084

(22) PCT Filed: May 10, 2006

(86) PCT No.: PCT/US2006/018296

§ 371 (c)(1),
(2), (4) Date: Apr. 1, 2009

(87) PCT Pub. No.: WO2007/130068

PCT Pub. Date: Nov. 15, 2007

(65) Prior Publication Data

US 2011/0103813 A1 May 5, 2011

(51) Int. Cl.
*G03G 15/00* (2006.01)
*G03G 15/043* (2006.01)

(52) U.S. Cl. ..... 399/49; 399/51; 399/52

(58) Field of Classification Search ..... 399/15, 399/51, 49, 52

See application file for complete search history.

(56) References Cited

U.S. PATENT DOCUMENTS

| | | | | |
|---|---|---|---|---|
| 4,879,576 | A * | 11/1989 | Naito | 399/52 |
| 4,977,414 | A | 12/1990 | Shimada et al. | |
| 6,070,022 | A * | 5/2000 | Kobayashi et al. | 399/49 |
| 6,188,427 | B1 * | 2/2001 | Anderson et al. | |
| 7,590,364 | B2 * | 9/2009 | Takezawa et al. | 399/49 |
| 2005/0071104 | A1 * | 3/2005 | Viturro et al. | |
| 2007/0086071 | A1 * | 4/2007 | Gila et al. | |

FOREIGN PATENT DOCUMENTS

| | | | |
|---|---|---|---|
| JP | 58174921 | | 10/1983 |
| JP | 60260072 | | 12/1985 |
| JP | 06148991 | A * | 5/1994 |
| JP | 10186743 | A * | 7/1998 |
| JP | 2002174930 | A * | 6/2002 |
| JP | 2002296709 | | 10/2002 |
| JP | 2003127459 | A * | 5/2003 |
| JP | 2005007697 | | 1/2005 |
| JP | 2005193603 | | 7/2005 |

* cited by examiner

*Primary Examiner* — Susan Lee

(57) ABSTRACT

A correction method for correcting unintended spatial variation in lightness across a physical image produced by a xerographic process, the method comprising producing a test image using the xerographic process, measuring a difference between actual lightness and intended lightness across at least part of the test image, and varying the light source level used subsequently in the xerographic process to correct for the measured unintended difference.

20 Claims, 5 Drawing Sheets

CORRECTION METHOD, APPARATUS, DATA CARRIER OR SYSTEM FOR CORRECTING FOR UNINTENDED SPATIAL VARIATION IN LIGHTNESS ACROSS A PHYSICAL IMAGE PRODUCED BY A XEROGRAPHIC PROCESS

RELATED APPLICATIONS

This application claims priority to, and is a US National Phase of, International Patent Application No. PCT/US2006/018296, having title "A CORRECTION METHOD, APPARATUS, DATA CARRIER OR SYSTEM FOR CORRECTING FOR UNINTENDED SPATIAL VARIATION IN LIGHTNESS ACROSS A PHYSICAL IMAGE PRODUCED BY A XEROGRAPHIC PROCESS", having been filed on 10 May 2006 and having PCT Publication No. WO2007/130068, commonly assigned herewith, and hereby incorporated by reference.

BACKGROUND

In this specification, xerographic process means a process for converting a digital image comprising pixels into a latent image comprising dots using light from a light source arranged to act on a photoconductive surface, by striking the surface, to form the latent image on the surface by changing the charge distribution on the surface in the regions of the dots, applying a toner/liquid ink to the surface such that the toner/liquid ink adheres to the surface in regions of the latent image and transferring the toner from the surface to a substrate to form a final image. The light source is arranged to act on the photoconductive surface by scanning across it in a direction known as the scan direction. The latent image corresponds to a digital image which is required to be reproduced. Some examples of xerographic machines which use xerographic processes are laser printers, digital printing presses, photocopiers, fax machines, plate setters, direct-to-film laser printers and scanned laser displays.

The term dot is intended to cover any shape which is produced by the light source when forming the latent image, e.g. circles, ellipses, dashes, lines etc, and could be considered to be "pixel", and is not limited to any particular shape. For example in most laser printers these dots would be substantially circular since they are formed by light from a laser striking a photoconductive surface at a point corresponding to a pixel to be reproduced and charge distribution is affected substantially symmetrically outwardly from this point.

In this specification dot gain means the dot gain associated with a xerographic process i.e. it is an expression of the size difference between the dot in the final physical image of the xerographic process (e.g. on paper) compared to the electronic, digital coverage in an original image being copied/printed etc. For example if the xerographic process is used to reproduce an original digital image comprising a pixel, the area covered by toner forming a dot representing the pixel in the final physical image will be different to the area covered by the pixel in the original electronic digital image.

Dot gain can be defined in a number of ways. For example, using the above example, dot gain can be defined as the logarithm of the ratio of the actual dot area (in the final image) and the digital pixel area (in the original image). Alternatively this dot gain can be expressed as the difference between covered area in the final image (i.e. area covered by dots) and covered area in the original image (i.e. area covered by pixels). These two definitions are examples of ways in which dot gain can be defined and both of these examples have the same sign (positive/negative) structure. Using these definitions, if the coverage in the original and final images is the same then the dot gain will be zero. In most printing processes the dot gain is usually non-zero and positive. Using the above example to illustrate, the coverage of the dot in the final image is usually greater than the coverage of the pixel in the original image which the dot represents.

The level of dot gain in an image formed using a xerographic process is dependent on, amongst other things, the way in which the light source acts on the surface to form the latent image. The extent to which light from the light source changes the charge distribution on the photoconductive surface affects the amount of toner or liquid ink (or other pigmenting material) which will adhere to the surface and therefore affects the level of dot gain. As an example, a first latent dot (at the photoconductive surface) may be formed using a xerographic process by a light source discharging a region on a charged surface at a first laser intensity for 0.1 seconds and a second latent dot may be formed using the xerographic process by the light source discharging a region on a charged surface at the first laser intensity for 0.2 seconds. The first and second regions may be discharged to different extents which may cause different amounts of ink or toner to adhere to the surface and thus to form the final image. This can affect the area covered by the ink or toner in the final image. Therefore the way in which the light source acts on the surface can affect dot gain.

In this specification the light source level is used to indicate how much light from the light source acts on the photoconductive surface. As discussed, this is related to the extent of change in charge distribution on the surface in regions where the light strikes and thus the amount of toner/ink which will adhere to the surface and is thus linked to the level of dot gain. Some other examples of how to vary the light source level received at the photoconductive surface are by operating the light source in different modes (e.g. power modes or scanning modes) for different periods of time, by operating the light source in bursts, by operating the light source at different intensity/power levels or by causing different amounts of light to act upon the surface in any other suitable way. If the light source is a laser one way of achieving a variation in the light source level is by laser power modulation or by laser pulse width modulation. In some xerographic processes light from the light source passes through a light directing arrangement, such as a polygon mirror, before acting on the surface. The light directing arrangement scans light across the surface in a desired manner. This may be achieved by moving the polygon mirror in a desired manner e.g. rotating it at a desired frequency. The light source level can be varied by varying the operation of the light directing arrangement, e.g. by changing the speed of rotation of the polygon mirror. Light acts on the surface by hitting the surface. Different amounts of light acting on the surface will cause different amounts of ink/toner to adhere to the surface in desired regions. Light source, in this specification can therefore be used to refer to, for example a laser, optics associated with the laser and scanning means, e.g. a polygon mirror associated with the laser, all in combination.

The ink/toner attracted to, or retained, on a charged electrostatic surface tends to creep outwards to cover a little more area than the area actually irradiated (or not irradiated in a "write-white" arrangement). The degree to which this dot gain occurs depends upon the amount of light used to expose the surface. Also, the thickness of ink/toner held to the charged regions of the surface depends upon the amount of exposure of light of the relevant area of the surface.

According to an aspect of the invention there is provided a method of making a modifier for modifying a xerographic machine, the xerographic machine comprising a light source used in a xerographic process, the modifier being arranged to modify instructions provided to the light source in order to control the light source to correct for unintended spatial variation in lightness across a physical image produced by the xerographic process, the method comprising the steps of producing a test image using the xerographic process, measuring a difference between actual lightness and intended lightness across at least part of the test image, and storing information relating to the measured difference on a memory of the modifier. The modifier is used to modify instructions received by the xerographic machine when producing an image.

According to a further aspect of the invention there is provided a method of making a printer capable of correcting for unintended spatial variation in lightness across a physical image produced by a xerographic process of the printer, the method comprising a normal printer, producing a test image using the xerographic process, measuring a difference between actual lightness and intended lightness across at least part of the test image, and calibrating a control system of the printer such that the light source level is controlled in subsequent uses of the xerographic process to correct for the measured unintended difference in lightness.

It should be appreciated that when an aspect of an invention is claimed or described as a particular category (e.g. as a method, system, data carrier, xerographic machine etc.) then protection is also sought for that aspect but expressed as a different category of the claim. For example a claim to a method may also be expressed as a xerographic machine capable of carrying out the method or a data carrier having software on it which instructs a processor to carry out the method.

DESCRIPTION OF THE DRAWINGS

Embodiments of the present invention will now be described by way of example only with reference to the accompanying drawings in which:

Referring to FIG. 1, a xerographic machine in the form of a printer comprises a photoconductor 10 that generally forms the outer surface of a rotatable cylindrical drum. During the printing process the surface of the photoconductor 10 is uniformly charged with static electricity by, for example, a corona discharge 12. Portions of the photoconductor 10 are exposed with light 14 from a light source 40 (illustrated in FIGS. 2 and 3). The drum is rotated so that the image to be printed is formed on the photoconductor 10. The light 14 discharges the charge on the drum in exposed areas and leaves a charged latent image. The latent image is then developed by applying a toner 16, such as a liquid ink toner (e.g. as in LEP printing) or a pigmented dry powder toner, over the surface of the photoconductor 10. The toner 16 adheres to the discharged areas of the photoconductor 10 so that the latent image becomes visible. The toner 16 is then transferred from the photoconductor 10 to a sheet of paper 18 or to some other medium which is to support the printed image. A fuser 20 may be used to fix the image to the paper 18 by applying heat and pressure, or pressure alone, to the toner 16 on the paper 18. The direct-to-paper transfer system shown in FIG. 1 represents only a subset of electrophotographic printers. Many electrophotographic printers use an intermediate transfer drum or belt to receive the toner image from the photoconductor and apply it to the print medium. Some printers have no separate fuser, and the fusing process occurs during the transfer from the intermediate transfer drum to the paper.

Referring to FIGS. 2 and 3, an optical system that can be used as part of the printer comprises a light source 40, optical components 25 that receive light from the light source and form a light spot 50 on a photosensitive surface 10, and a scanning device that deflects the light spot 50 across the photosensitive surface 10. FIG. 2 shows a plan view of the optical system whereas FIG. 3 shows a perspective view of the optical system. The scanning device may take the form of, for example, a polygon mirror 26. FIG. 2 illustrates the scanning device as a hexagonal mirror 26, although a mirror with more or less sides could be used or a refractive or diffractive optical element could be used. Rotation of the mirror 26 causes light from the light source 40 to be deflected by one of the mirror's faces and thereby cause the light spot 50 to scan from one side of the photosensitive surface 10 to the other to produce a scan line 52. That is, for a cylindrical photosensitive surface, the light is scanned in a direction parallel to the longitudinal axis of the cylinder—this is known as the scan direction. As the mirror 26 is further rotated, the laser light will become incident on a different mirror facet and a new scan across the photosensitive surface 10 is started. In this way a latent image is built up on the photosensitive surface 10 as a series of scan lines.

Figure 2:
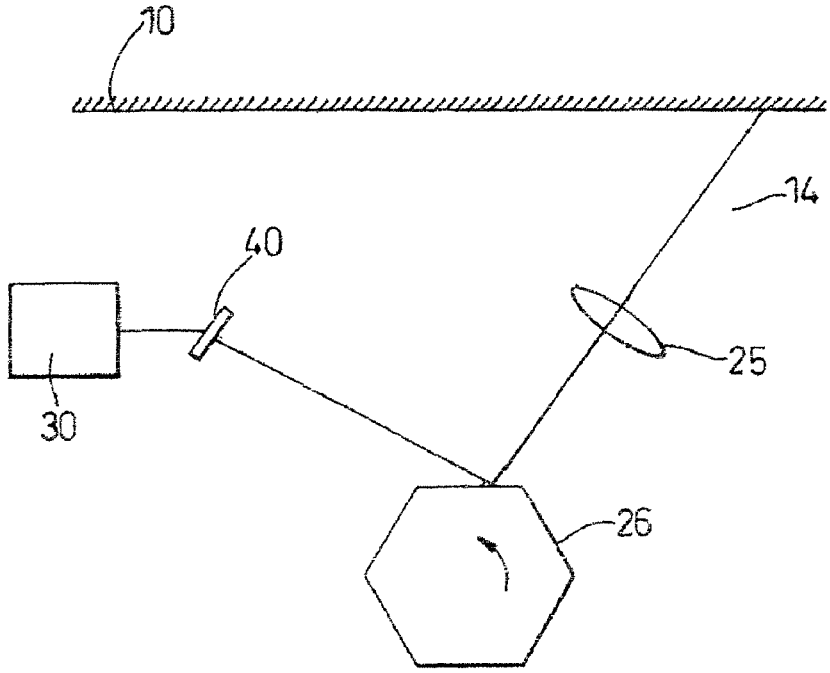
FIG. 2 schematically illustrates an optical system, according to an embodiment of the invention for use with the printer of FIG. 1.
Figure 3:
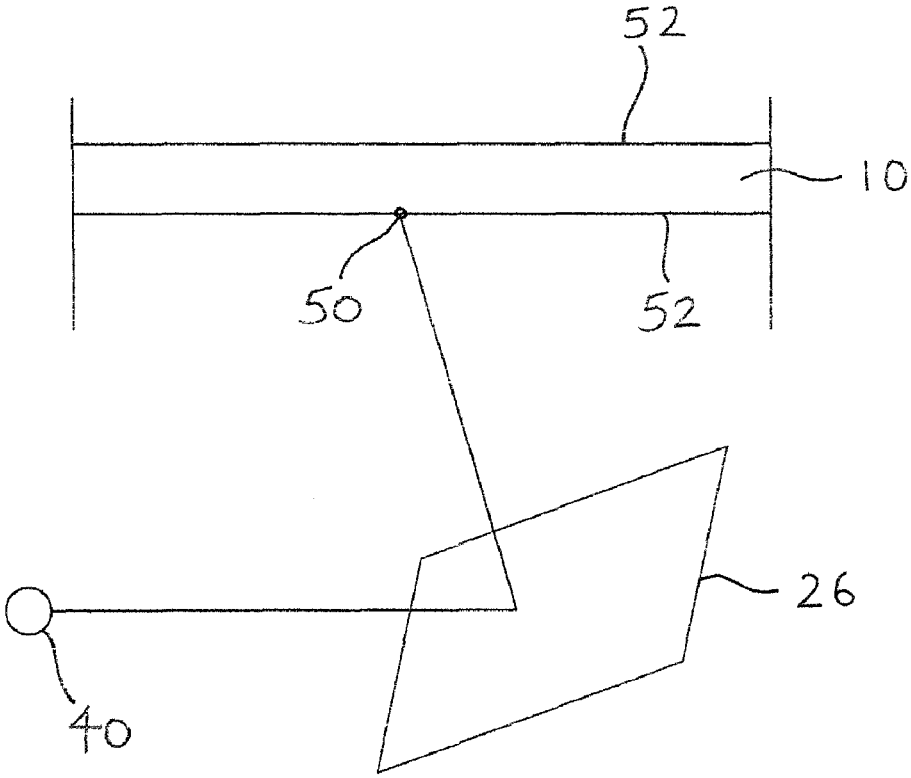
FIG. 3 is a schematic perspective view of the optical system of FIG. 2.

In the example illustrated in FIG. 3, a scan line 52 is produced by scanning the light output from the light source 40 in the array of light source 40. It should be understood that FIG. 3 is purely schematic and the geometry of the light ray is not intended to be accurate. An image is produced on the photoconductor 10 as a series of scan lines 52. In the optical system illustrated in FIGS. 2 and 3, the rotation of polygon mirror 26 causes each successive facet of the polygon to produce a successive scan line 52. In other embodiments, an array of light sources may be used instead of a single light source. In such embodiments an array of light sources scanning from one side of the photosensitive surface to the other will produce a swath of scan lines. There may be 2, 3, 4, 5, 6, 7, 8, 9, 10 or any other suitable number of scan lines in a swath (i.e. number of light sources in an array). Generally, the number of scan lines in a swath will be determined by the process speed and addressability of the printer. In general, the gap between adjacent swaths will be the same, or about the same, as the gap between adjacent scan lines within a swath.

In some embodiments, the optical system may comprise other optical components such as, amongst others, a lens to collimate the light from a light source or array of light sources, mirrors to direct the light so that it follows a desired route through the printer and a scan lens to focus light reflected from the polygon mirror onto the photoconductor.

It should be noted that other arrangements could be used to scan light across the photoconductor 10. In some arrangements the light can be scanned across the photoconductor 10 by having the beam from the light source 40 in a fixed position and moving the photoconductor 10 in order to produce the scan lines on the photoconductor 10. In other arrangements both the photoconductor 10 and the light source 40 and/or other optical elements may be moved in order to create the scan lines on the photoconductor 10.

The beam of light 14 from the light source 40 is modulated by a controller 30 so that the appropriate portions of the photoconductor 10 are illuminated in order to obtain the desired latent image on the photoconductor 10. The controller 30 may function by sending electrical signals to the light source 40 to control the optical power produced by the light source. In this embodiment, the light source 40 is able to produce a beam of variable intensity depending upon instructions received from the controller 30. In other embodiments, the controller 30 can control the light source level in any other suitable manner, e.g. by changing the speed of rotation of the polygon mirror, or by pulse width modulation, or chopping the laser beam, or in any other way.

The light source 40 comprises a laser in this embodiment but other light sources that can produce the required exposure energy density could also be used. In other embodiments of the invention the light source comprises a vertical cavity surface emitting laser (VCSEL). For example, in an embodiment in which an array of light sources is used, an array of VCSELs can be manufactured on a single wafer with a small spacing between the lasers. For example, the spacing between the lasers may be of the order of 30 μm in both coordinate directions (i.e. the scan direction and cross-scan (orthogonal to scan) directions) of the array. An array of VCSELs can be manufactured with an arbitrary spacing between the lasers above the minimum spacing that is practical. The minimum spacing is currently about 30 μm however this may become smaller as manufacturing techniques improve. An array of VCSELs can typically be produced for significantly less cost than an array of edge-emitting lasers.

The light source 40 is capable of producing a beam of light 14 that forms a light spot 50 that is scanned across the photoconductor 10. The light spot 50 exposes the scan line 52 on the photoconductor 10.

Figure 1:
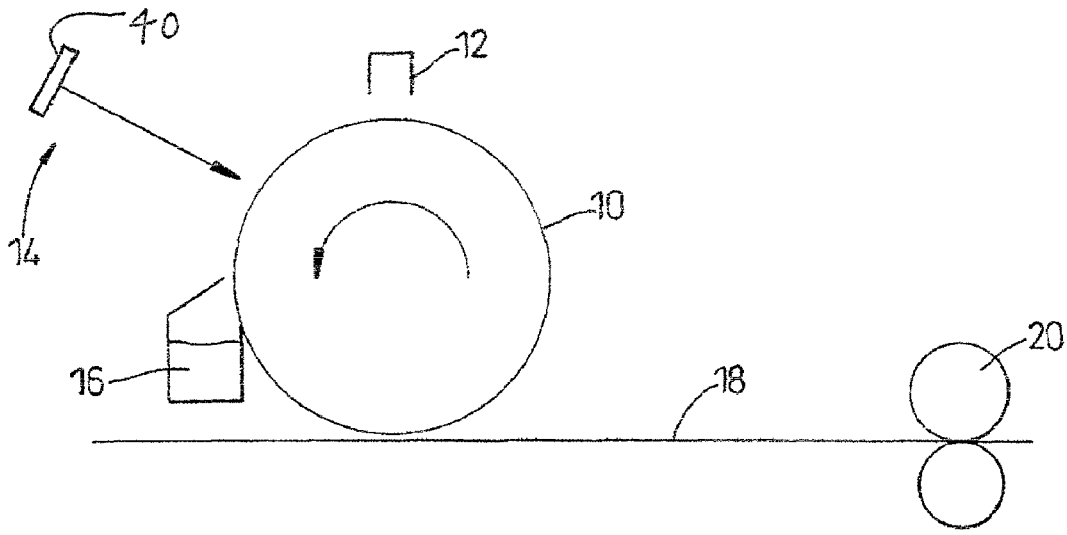
FIG. 1 schematically illustrates a printer according to an embodiment of the invention.

Two directions may be defined in relation to the light spot 50: one direction is the scan, or format, direction X which is the direction in which a spot 50 is scanned in order to produce a scan line 52. The other direction is the process direction Y (also referred to as the "cross-scan direction" or "transverse to the scan direction") which is substantially orthogonal to the format direction. The process direction is the direction in which the surface of the photoconductor 10 or other photosensitive medium is moved relative to the light spot 50 in order to generate an image from scan lines 52. For the printer illustrated in FIG. 1, the process direction is defined by the direction of rotation of the photoconductor drum 10.

Figure 4:
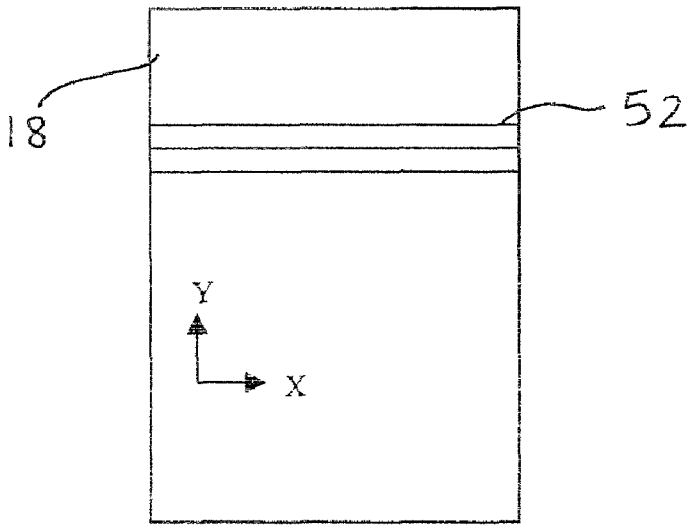
FIG. 4 schematically illustrates a page printed by the printer of FIG. 1.

Referring to FIG. 4, a piece of paper 18 produced by the printer is shown. Scan lines 52 run across the piece of paper from left to right in the scan direction X and orthogonal to the process direction Y. In existing xerographic printing processes, variations in the xerographic process, e.g. caused by environmental temperature, pressure, xerographic machine optics, dot gain or any other factor, can cause unintended spatial variation in the printing process as described in more detail below.

Figure 5:
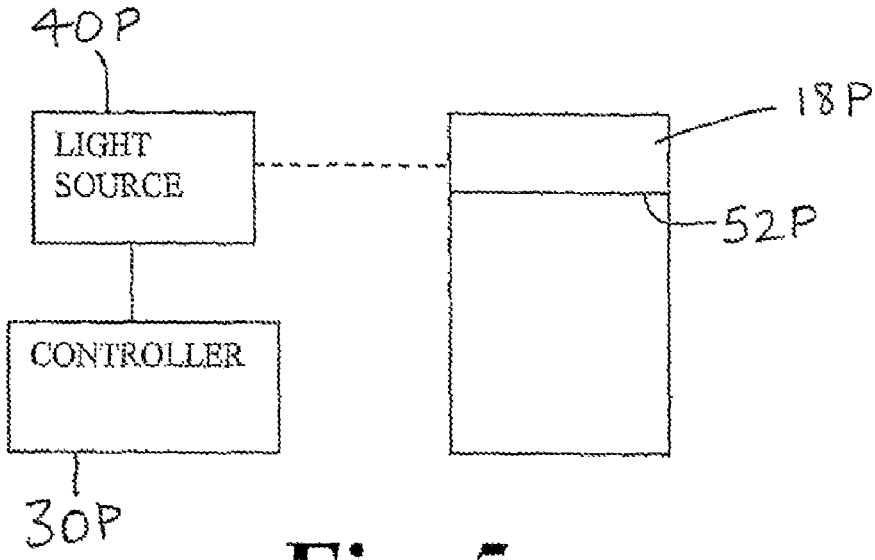
FIG. 5 schematically illustrates a control system for a prior art printer.

Referring to FIG. 5, a control system for a prior art printer is shown. The prior art printer comprises a controller 30P which is arranged to instruct a light source 40P used in a xerographic process to produce an image on a piece of paper 18P. The image comprises a scan line 52P. In producing the scan line 52P the controller 30P has instructed the light source 40P to operate at the same light source level across the entire spatial distance of the scan line 52P i.e. the scan line 52P is intended to have the same lightness across its length. In this specification lightness is the measure of the optical density or reflectivity of an image. Lightness also covers the term colour i.e. if it is intended that a scan line is intended to have the same colour across its length this means that it is intended to have the same optical density and thus lightness i.e. appearance to a user across its length.

In this example, the scan line 52P of the prior art is intended to be a red line of constant lightness. However, due to imperfections in the xerographic process, even though the controller 50P instructs the laser 40P to operate at the same light level when producing the whole of the scan line 52P, the scan line 52P is actually a deeper shade of red towards the centre of the page 18P and a lighter shade of red towards the edges of the page 18P. This is obviously undesirable since a user operating the printer intended for the scan line 52P to have a constant colour/lightness.

Figure 6:
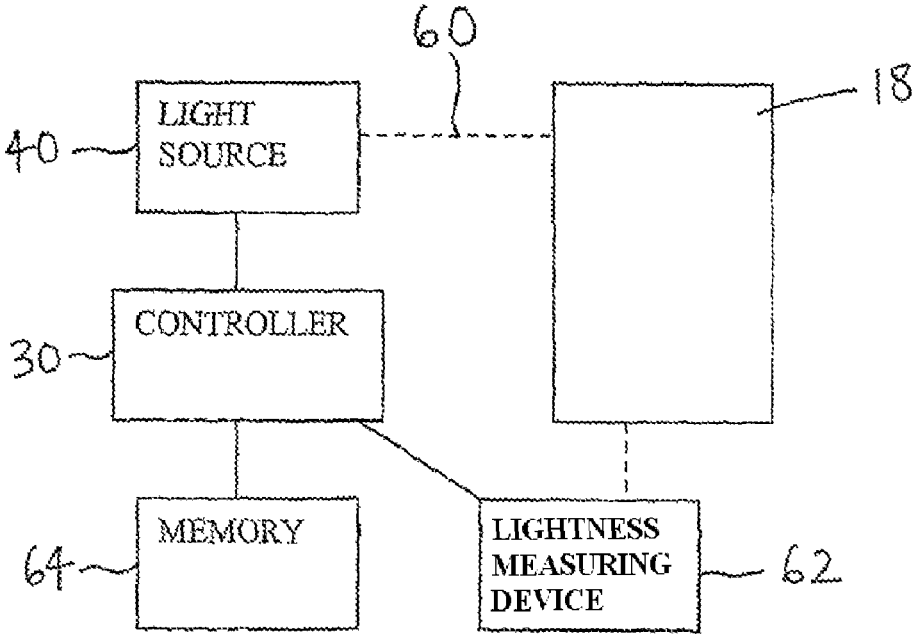
FIG. 6 schematically illustrates a control system for the printer shown in FIG. 1.

Referring to FIG. 6 a control system according to this embodiment of the invention is shown. The control system comprises the controller 30 in communication with the light source 40 of the printer, the light source 40 being arranged to be used in a xerographic process 60 to produce the piece of the paper 18 bearing a produced image. In addition, the printer comprises a lightness measuring device 62. In this embodiment the lightness measuring device comprises a scanner 62. Scanners are well known in the art and generally comprise a light source for irradiating an object being scanned and a light detector for measuring light reflected off or passed through the object in order to determine the lightness of the object or an image on the object.

The scanner 62 is arranged to measure the lightness of an image such as the scan line 52 on the paper 18 produced by the xerographic process 60. The scanner is also arranged to communicate with the controller 30. The control system also includes a memory 64 which is accessible by the controller 30.

Figure 7:
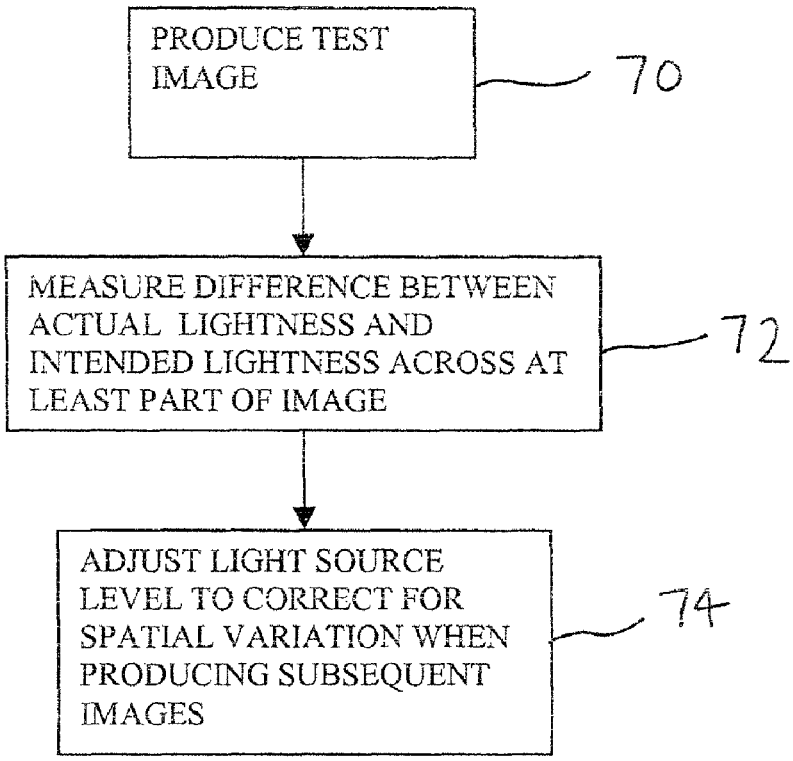
FIG. 7 is a flow chart illustrating operation of the printer of FIG. 1.
Figure 8:
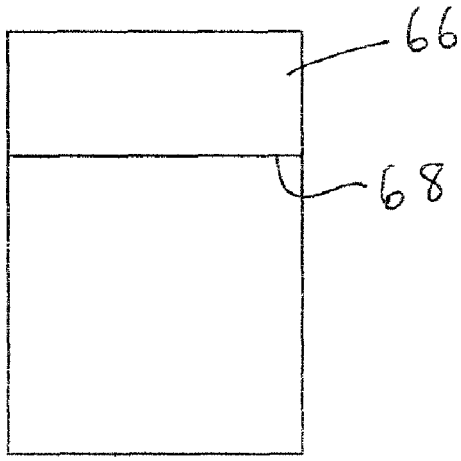
FIG. 8 schematically illustrates a page printed by the process of FIG. 7.

Referring to FIG. 7, in use, when it is desired to produce an image on a piece of paper 18 comprising a scan line 52 having a constant lightness across its length, the controller 30 is arranged to instruct the light source 40 to operate at a desired constant light source level to produce a test image 66 comprising a scan line 68 (see FIG. 8). Due to imperfections in the xerographic process 60, the scan line 68 does not actually have a constant lightness across its length as intended.

Referring to FIG. 7, a method of printing an image via the xerographic process 60 which takes into account unintended spatial variation in lightness caused by the xerographic process 60 comprises an initial step 70 of producing the test image 66.

Figure 9:
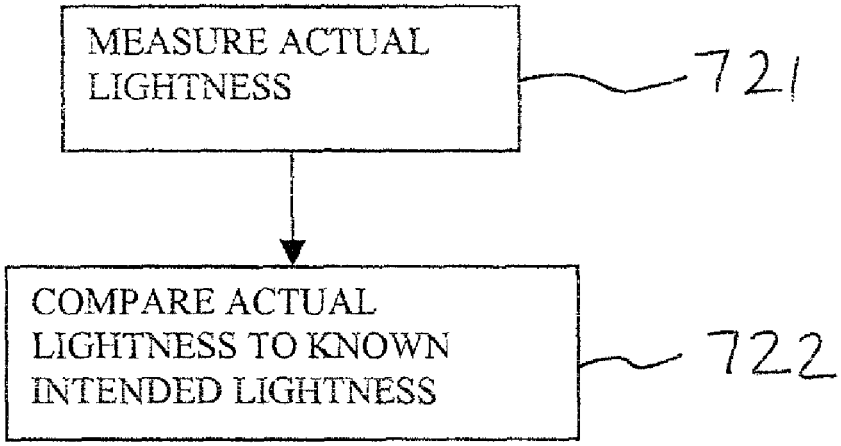
FIG. 9 is a flow chart showing steps involved within the step 72 of the flow chart of FIG. 7.

At step 72 the difference between the actual lightness and the intended lightness across at least part of the image is measured. In this embodiment the difference is measured across the entire length of the scan line 68, but in other embodiments it may only be measured within certain margins or within any other constraints which for example may be set by a user. For example in this embodiment the difference is measured in the scan direction of the xerographic process but in other embodiments the difference can be measured in any other direction, e.g. the process direction or a combination of the scan and process directions. In this embodiment the difference is measured by the scanner 60 which is arranged to measure the lightness across the entire scan line 68 of the test image 66. The controller 30 receives information on the actual lightness of the scan line 68 across its length from the scanner 60. FIG. 9 shows that in this particular embodiment, measuring the difference between the actual lightness and intended lightness across at least part of the image comprises the initial step 721 of measuring the actual lightness before comparing the actual lightness to a known intended lightness at step 722. The controller 30 knows the intended lightness of the scan line 68 since it initially instructed the light source 40 to produce the scan line 68 at the intended lightness.

In this embodiment the intended lightness is expressed as a halftone value on a greyscale between 0 and 255 (0=White, 255=Black). In other embodiments halftone values may be expressed between different integer values and on colour scales as opposed to greyscales. Relationships between halftone value (i.e. intended lightness) and actual lightness on a printed page are well known in the art and existing printers compensate for the fact that the relationship between intended lightness (halftone value) and actual lightness of the printed image following the xerographic process is not linear.

In yet further embodiments the intended lightness is not known as an absolute value on a greyscale or colour scale. Instead, for example, the intended lightness instead may be matched to a measured statistical value, such as an average value of the lightness, across an image produced by the xerographic process. In this way, although the original absolute lightness on a scale is not known, an average value of the lightness across the image is assumed to be sufficiently indicative as the intended lightness. The average value may be a mean average across the produced image and advantageously the effect of any positive or negative (i.e. 'too light' or 'too dark') parts across the image will be minimised as they may substantially cancel each other out. In other embodiments the average may be a mode average i.e. the values of lightness which occur most often may be taken as indicative of the intended lightness. Advantageously the effect of parts across the image which are too light/too dark can be ignored altogether if they are statistically insignificant. In other embodiments the average value may be a median average value of lightness across an image. It is particularly useful to use average values as intended lightness values when it is intended to print across an image with a constant lightness. These ideas help us to stabilise lightness across a printed page, or part of a page (or image). An image may occupy all of a page or part of a page.

After step 722 where the controller 30 compares the actual lightness to the known intended lightness, the controller is arranged to determine the difference between the actual lightness and intended lightness as a function of the distance across the scan line 68 i.e. the controller 30 determines the spatial variation in the measured difference.

In this embodiment the determination made by the controller 30 is expressed in the form of a multiplier look-up table 80 stored in the memory 64. As previously indicated, the relationship between intended lightness (i.e. halftone values intended to be printed) and actual lightness on a page 18 is well known and the memory 64 already includes a halftone compensation look-up table 82 which the controller 30 is able to access.

In this embodiment of the present invention the controller 30 is arranged to produce a final look-up table 84 by combining the multiplier, or spatial compensation correlation, look-up table 80 with the halftone look-up table 82. Initially the halftone look-up table 82 does not have any concept of spatial variation. The multiplier look-up table introduces this concept on the basis of the measured difference at step 72 of the correction method of this invention. The final look-up table 84 thus provides a table of values that can be used as multipliers to adjust the light source level to correct the spatial variation when producing subsequent images (step 74). In this way the measured spatial variation is compensated for in the xerographic process 60.

Advantageously, it is not necessary using the method of the present invention to identify what causes imperfections in the xerographic process. This is because the method of the present invention compensates for any imperfections without needing to know what they are. Therefore the method of the present invention is beneficial over any system which may seek to identify the cause of imperfections of the xerographic process and address each cause separately. For example if it were identified that the optical set up of the printer was causing spatial variations, although this issue can be addressed separately, there may also be an additional, unknown factor which may be influencing the spatial variation. The method of the present invention deals with all imperfections together and it is not required to separate them.

In this embodiment, the multiplier look-up table 80 and hence the final look-up table 84 is relevant for all colours. In other embodiments, distinct tables may be created for each colour required. In this embodiment, the multiplier look-up table 80 and hence the final look-up table 84 includes 360 values across the width of the page 18. In other embodiments this number may be more or less. This number of values may be dependent upon the printing resolution of the printer. For example at a higher printing resolution, more values may be needed since there will be more dots per scan line.

Also, in other embodiments, the scanner 60 may not be part of the printer. In these embodiments, the scanner 60, or other measuring device, may be totally separate. For example, the scanner 60 may be used in a factory when the printer is first made, the spatial variation look-up table LUT established by measuring actual print results and comparing them with intended results, and the spatial variation LUT may subsequently never altered again. In such embodiments, the final look-up table 84 is assumed to be correct throughout the life of the printer. In other embodiments, the correction method of FIG. 7 may be implemented with a distinct scanner 60 from time to time upon the desire of the user—e.g. monthly, yearly, daily etc.

In the present embodiment where the scanner 60 is part of the printer, this can make it more convenient to generate a new final look-up table 84 more often. For example, it could be done after or before every print job or periodically (every few hours, every day, every month, every year) or it could be done after a specific trigger, for example a certain number of pages printed for example.

In some embodiments, the final look-up table 84 replaces the multiplier look-up table 80 and halftone look-up table after it 84 has been created. In this way the memory 64 is not required to store separate look-up tables which are not being used.

In one embodiment, the memory 64 may contain a bypass look-up multiplexer table 86. The bypass look-up multiplexer table simply has every value set to 1, i.e. no correction is made when the halftone look-up table 82 is combined with the bypass look-up table 86. The result of this is that the final look-up table 84 is the same as the halftone look-up table 82. This may be useful in situations where, for any reason, a user does not want correction of unintended spatial variation in halftone values of a print job. In such embodiments, the processor 30 is in communication with a user interface (not shown) by which the user is able to indicate that they do not want to have correction for spatial variation.

Figure 10:
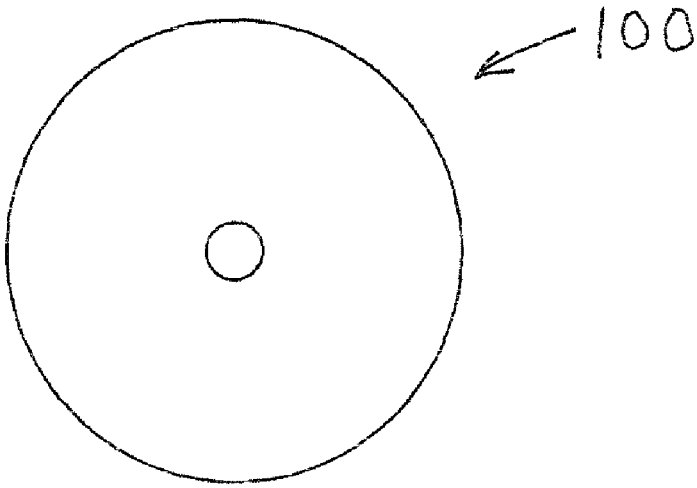
FIG. 10 shows a data carrier according to a further embodiment of the invention.

Referring to FIG. 10, the invention may be implemented by supplying a data carrier, in this embodiment, a compact disc 100 containing software arranged to run on the processor of an existing printer and cause it to carry out the method of FIG. 7.

An embodiment of the invention can be considered to be a method of manufacturing a printer. The multiplier LUT is, for many embodiments, in a memory that is a component of a printer. This ensures that each printer has been individually bespoke "fine-tuned", for example as a quality control/final setting operation in a factory making printers and avoids operating/linking a printer with the wrong spatial aberration compensation LUT.

The invention claimed is:

1. A correction method for correcting unintended spatial variation in lightness across a physical image produced by a xerographic process, the method comprising:

producing a test image using the xerographic process, measuring a difference between actual lightness and intended lightness across at least part of the test image, and varying a light source level used subsequently in the xerographic process to correct for the measured unintended difference.

2. The method of claim 1, wherein the step of varying the light source level comprises varying the light source level such that the actual lightness is substantially equal to the intended lightness across said at least part of the image.

3. The method of claim 1, wherein the measuring step comprises measuring across the image in a scan direction of the xerographic process and using results of said measuring to vary the light source level used subsequently in the xerographic process in the scan direction.

4. The method of claim 2, wherein the measuring step comprises measuring across the image in a scan direction of the xerographic process and using results of said measuring to vary the light source level used subsequently in the xerographic process in the scan direction.

5. The method of claim 1, wherein the measuring step comprises measuring the actual lightness and comparing it to a known intended lightness.

6. The method of claim 2, wherein the measuring step comprises measuring the actual lightness and comparing it to a known intended lightness.

7. The method of claim 3, wherein the measuring step comprises measuring the actual lightness and comparing it to a known intended lightness.

8. The method of claim 4, wherein the measuring step comprises measuring the actual lightness and comparing it to a known intended lightness.

9. The method of claim 5, wherein the known intended lightness is provided by reading a tag associated with a data pixel in an original digital image to be converted into the physical image by the xerographic process or wherein the intended lightness is provided by measuring an average value of lightness across the physical image.

10. The method of claim 6, wherein the known intended lightness is provided by reading a tag associated with a data pixel in an original digital image to be converted into the physical image by the xerographic process or wherein the intended lightness is provided by measuring an average value of lightness across the physical image.

11. The method of claim 7, wherein the known intended lightness is provided by reading a tag associated with a data pixel in an original digital image to be converted into the physical image by the xerographic process or wherein the intended lightness is provided by measuring an average value of lightness across the physical image.

12. The method of claim 8, wherein the known intended lightness is provided by reading a tag associated with a data pixel in an original digital image to be converted into the physical image by the xerographic process or wherein the intended lightness is provided by measuring an average value of lightness across the physical image.

13. A xerographic machine, such as a printer, comprising:

a light source used in a xerographic process for producing a physical image, a controller arranged to access information relating to an amount of unintended spatial variation in lightness across an image produced by the xerographic process, said information having been obtained by producing a test image using the xerographic process, measuring a difference between actual lightness and intended lightness across at least part of the test image, and determining the amount of unintended spatial variation in lightness across the test image, the controller being further arranged to use said information to control a light source level used subsequently in the xerographic process to correct for the unintended spatial variation in lightness across a physical image produced by the xerographic process.

14. The machine of claim 13 further comprising a memory arranged to store the information.

15. The machine of claim 13, wherein the controller is arranged to selectively vary the light source level such that a user can choose not to correct for unintended spatial variation.

16. The machine of claim 13, wherein the information is obtained by measuring across the image in a scan direction of the xerographic process and using the results of said measuring to vary the light source level used subsequently in the xerographic process in the scan direction.

17. The machine of claim 13, wherein the controller is arranged to receive print instructions in the form of a table of print values and the information is in the form of a table of correction values from the group:—

(i) correction multiplier values; or (ii) other correction values.

18. The machine of claim 13 further comprising a lightness measuring device arranged to measure spatial variation in lightness in order to provide said information.

19. A non-transitory data carrier carrying software arranged to be run on a processor to enable the processor to control a production of a physical image using a xerographic process, by varying a light source level of a light source used in the xerographic process to compensate for unintended spatial variation in lightness across the physical image, the extent to which the light source level is varied having been determined or to be determined by producing an earlier test image using the xerographic process, measuring a difference between actual lightness and intended lightness across at least part of the earlier test image and determining the extent to which the light source level is required to be varied to correct for the measured unintended difference.

20. The non-transitory data carrier of claim 19 wherein the physical image is a subsequent physical test image produced using results from measuring said earlier test image.

* * * * *